US005870846A

United States Patent [19]

Ledford

[11] Patent Number: 5,870,846

[45] Date of Patent: Feb. 16, 1999

[54] DOUBLE BARREL SHOTGUN

[76] Inventor: Tim Ledford, 707 Cottage St., Shorewood, Ill. 60431

[21] Appl. No.: 988,648

[22] Filed: Dec. 11, 1997

[51] Int. Cl.[6] ..... F41A 21/00

[52] U.S. Cl. ..... 42/75.04; 42/75.01

[58] Field of Search ..... 42/75.01, 75.04

[56] References Cited

U.S. PATENT DOCUMENTS

| | | | |
|---|---|---|---|
| 1,834,544 | 12/1931 | Klebe | 42/42.01 |
| 3,879,877 | 4/1975 | Cizeron | 42/42 R |
| 4,242,825 | 1/1981 | deBoer | 42/1 R |
| 4,265,044 | 5/1981 | Beretta | 42/41 |
| 4,290,220 | 9/1981 | Ruger | 42/75 D |
| 4,380,881 | 4/1983 | Klavestad | 42/42 R |
| 4,867,039 | 9/1989 | Dobbins | 89/127 |

*Primary Examiner*—Charles T. Jordan
*Assistant Examiner*—Meena Chelliah

[57] ABSTRACT

A new double barrel shotgun for increasing firing capacity and allowing simultaneous pump action of both forearm members or independent operation of one firing mechanism if one barrel becomes unusable due to jamming. The inventive device includes a receiver with a pair of elongate spaced apart barrels coupled at their rear ends to the front end of the receiver. A pair of spaced apart elongate magazine tubes are also coupled at their rear ends to the receiver front end. A pair of spaced apart forearm members for manually ejecting spent shells from the receiver and loading new shells into the receiver from the magazine tubes are slidably coupled to the magazine tubes. An elongate brace member is interposed between the barrels to hold the barrels together and help dissipate heat from the barrels.

14 Claims, 3 Drawing Sheets

DOUBLE BARREL SHOTGUN

BACKGROUND OF THE INVENTION

1. Field of the Invention

The present invention relates to shotguns and more particularly pertains to a new double barrel shotgun for increasing firing capacity and allowing simultaneous pump action of both forearm members or independent operation of one firing mechanism if one barrel becomes unusable due to jamming.

2. Description of the Prior Art

The use of shotguns is known in the prior art. More specifically, shotguns heretofore devised and utilized are known to consist basically of familiar, expected and obvious structural configurations, notwithstanding the myriad of designs encompassed by the crowded prior art which have been developed for the fulfillment of countless objectives and requirements.

Known prior art shotguns include U.S. Pat. No. 4,867,039; U.S. Pat. No. 5,054,221; U.S. Pat. No. 5,452,533; U.S. Pat. No. 4,265,044; U.S. Pat. No. 3,879,877; and U.S. Pat. No. Des. 249,954.

While these devices fulfill their respective, particular objectives and requirements, the aforementioned patents do not disclose a new double barrel shotgun. The inventive device includes a receiver with a pair of elongate spaced apart barrels coupled at their rear ends to the front end of the receiver. A pair of spaced apart elongate magazine tubes are also coupled at their rear ends to the receiver front end. A pair of spaced apart forearm members for manually ejecting spent shells from the receiver and loading new shells into the receiver from the magazine tubes are slidably coupled to the magazine tubes. An elongate brace member is interposed between the barrels to hold the barrels together and help dissipate heat from the barrels.

In these respects, the double barrel shotgun according to the present invention substantially departs from the conventional concepts and designs of the prior art, and in so doing provides an apparatus primarily developed for the purpose of increasing firing capacity and allowing simultaneous pump action of both forearm members or independent operation of one firing mechanism if one barrel becomes unusable due to jamming.

SUMMARY OF THE INVENTION

In view of the foregoing disadvantages inherent in the known types of shotguns now present in the prior art, the present invention provides a new double barrel shotgun construction wherein the same can be utilized for increasing firing capacity and allowing simultaneous pump action of both forearm members or independent operation of one firing mechanism if one barrel becomes unusable due to jamming.

The general purpose of the present invention, which will be described subsequently in greater detail, is to provide a new double barrel shotgun apparatus and method which has many of the advantages of the shotguns mentioned heretofore and many novel features that result in a new double barrel shotgun which is not anticipated, rendered obvious, suggested, or even implied by any of the prior art shotguns, either alone or in any combination thereof.

To attain this, the present invention generally comprises a receiver with a pair of elongate spaced apart barrels coupled at their rear ends to the front end of the receiver. A pair of spaced apart elongate magazine tubes are also coupled at their rear ends to the receiver front end. A pair of spaced apart forearm members for manually ejecting spent shells from the receiver and loading new shells into the receiver from the magazine tubes are slidably coupled to the magazine tubes. An elongate brace member is interposed between the barrels to hold the barrels together and help dissipate heat from the barrels.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new double barrel shotgun apparatus and method which has many of the advantages of the shotguns mentioned heretofore and many novel features that result in a new double barrel shotgun which is not anticipated, rendered obvious, suggested, or even implied by any of the prior art shotguns, either alone or in any combination thereof.

It is another object of the present invention to provide a new double barrel shotgun which may be easily and efficiently manufactured and marketed.

It is a further object of the present invention to provide a new double barrel shotgun which is of a durable and reliable construction.

An even further object of the present invention is to provide a new double barrel shotgun which is susceptible of a low cost of manufacture with regard to both materials and labor, and which accordingly is then susceptible of low prices of sale to the consuming public, thereby making such double barrel shotgun economically available to law enforcement and military personnel with suitable applications to the buying public.

Still yet another object of the present invention is to provide a new double barrel shotgun which provides in the apparatuses and methods of the prior art some of the advantages thereof, while simultaneously overcoming some of the disadvantages normally associated therewith.

Still another object of the present invention is to provide a new double barrel shotgun for increasing firing capacity and allowing simultaneous pump action of both forearm members or independent operation of one firing mechanism if one barrel becomes unusable due to jamming.

Yet another object of the present invention is to provide a new double barrel shotgun which includes a receiver with a pair of elongate spaced apart barrels coupled at their rear ends to the front end of the receiver. A pair of spaced apart elongate magazine tubes are also coupled at their rear ends to the receiver front end. A pair of spaced apart forearm members for manually ejecting spent shells from the receiver and loading new shells into the receiver from the magazine tubes are slidably coupled to the magazine tubes. An elongate brace member is interposed between the barrels to hold the barrels together and help dissipate heat from the barrels.

Still yet another object of the present invention is to provide a new double barrel shotgun that is capable of continuous firing, even if one barrel becomes unusable due to jamming.

Even still another object of the present invention is to provide a new double barrel shotgun that provides a larger magazine capacity than conventional shotguns.

Even still yet another object of the present invention is to provide a new double barrel shotgun that is capable of continuous firing with less risk of overheating the barrels.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
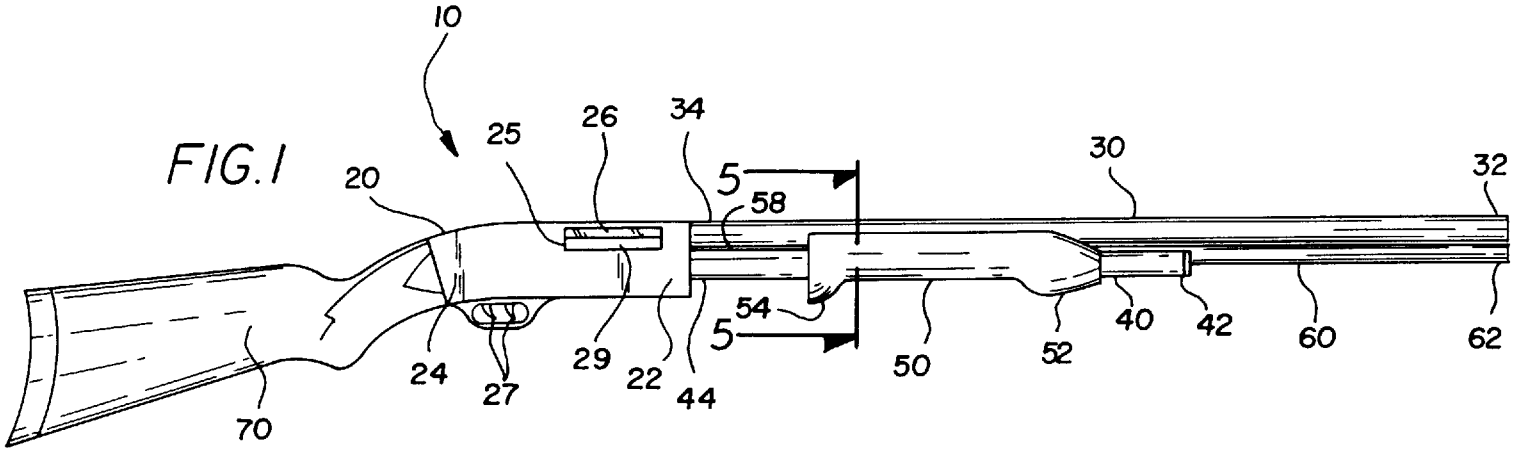
FIG. 1 is a side view of a new double barrel shotgun according to the present invention.
Figure 2:
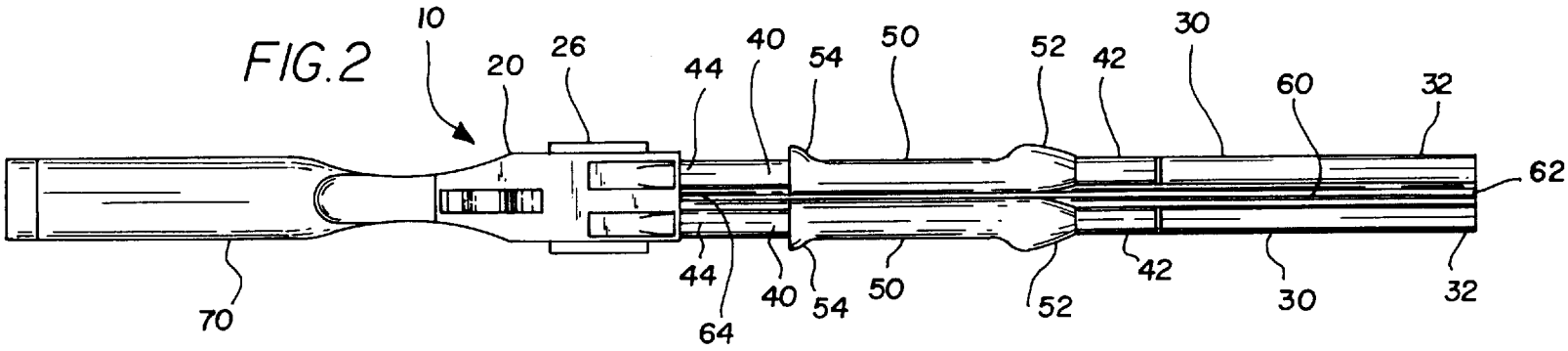
FIG. 2 is a bottom view of the present invention.

With reference now to the drawings, and in particular to FIGS. 1 through 5 thereof, a new double barrel shotgun embodying the principles and concepts of the present invention and generally designated by the reference numeral 10 will be described.

As best illustrated in FIGS. 1 through 5, the double barrel shotgun 10 comprises a receiver 20 with a pair of elongate spaced apart barrels 30 coupled at their rear ends 34 to the front end 22 of the receiver 20. A pair of spaced apart elongate magazine tubes 40 are also coupled at their rear ends 44 to the receiver front end 22. A pair of spaced apart forearm members 50 for manually ejecting spent shells from the receiver 20 and loading new shells into the receiver 20 from the magazine tubes 40 are slidably coupled to the magazine tubes 40. An elongate brace member 60 is interposed between the barrels 30 to hold the barrels 30 together and help dissipate heat from the barrels 30.

Although the present invention will be hereinafter described with reference to a pump-action shotgun, it will become apparent to those skilled in the art that semi-automatic firing mechanisms may be employed.

Preferably, the receiver 20 is of a type known to those skilled in the art and includes a first and second firing mechanism and first and second ejection ports 25. Ideally, the ejection ports 25 include detachable deflector shields 26 to deflect spent shells downward, away from the face of the user. The receiver 20 also includes a pair of triggers 27 and a pair of bolts 29, each bolt 29 for receiving shells from a magazine tube 40 and pushing them into a barrel chamber for firing. Ideally, each trigger 27 operates one firing mechanism, allowing for firing of one shell independent of the other. Optionally, a single trigger mechanism may be used to fire one or both shells at a time.

Preferably each barrel 30 is spaced apart from the other and coupled at its rear end 34 to the receiver front end 22. One or both barrels 30 may include interchangeable chokes (not shown). One or both barrels 30 may also include rifling for the firing of slug ammunition. Ideally, the barrels 30 are available in a variety of calibers and gauges.

Figure 5:
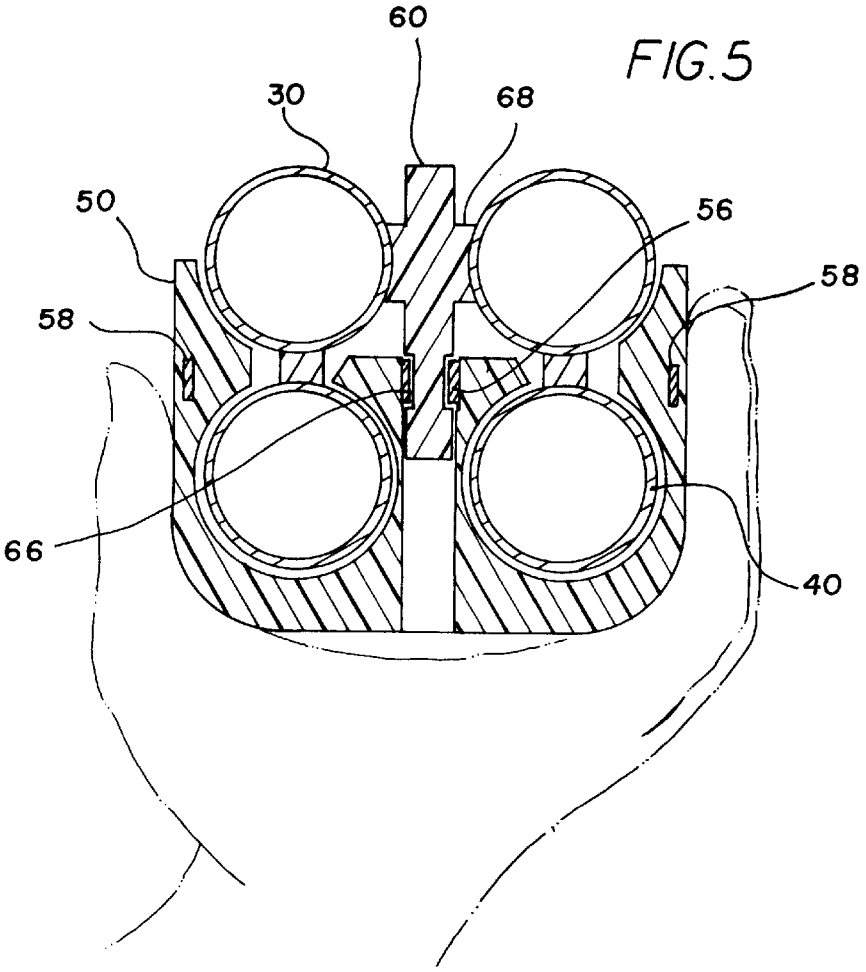
FIG. 5 is a sectional view taken from line 5—5 of FIG. 1.

The magazine tubes 40 are coupled at their rear ends 44 to the receiver 20. Preferably, as illustrated in FIG. 5, each magazine tube 40 is coupled to a barrel 30. Also preferably, as shown in FIGS. 1 and 5, each magazine tube is positioned beneath a barrel.

Each magazine tube 40 comprises a cylindrical tube having a closed front end 42, an open rear end 44, and a spring (not shown) within. Shells are inserted into the open rear end 44 of the magazine tube 40 to be stored there in an end to end relationship. The spring provides tension, forcing the shells towards the magazine tube rear end 44. Preferably, each magazine tube 40 has a capacity of three to five shells. However, each magazine tube 40 may be dimensioned to hold up to about 9 shells.

The forearm members 50 are used to manually eject spent shells from the chambers and load new shells from the magazine tubes 40 into firing position. The forearm members 50 are spaced apart and each is slidably mounted on a magazine tube 40.

Figure 3:
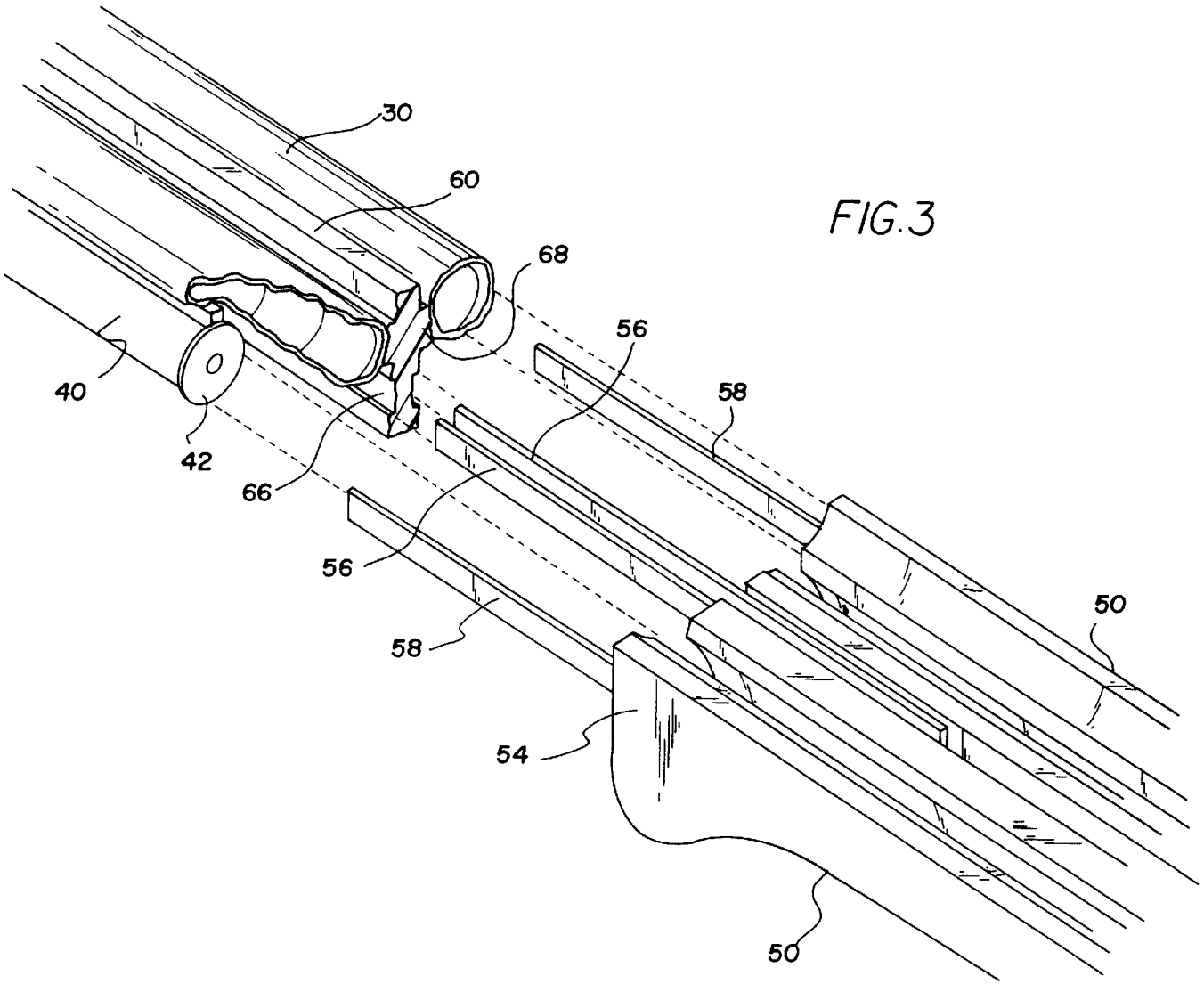
FIG. 3 is a break away perspective view particularly illustrating the relationship of the forearm members to the barrels, magazine tubes, and brace member.
Figure 4:
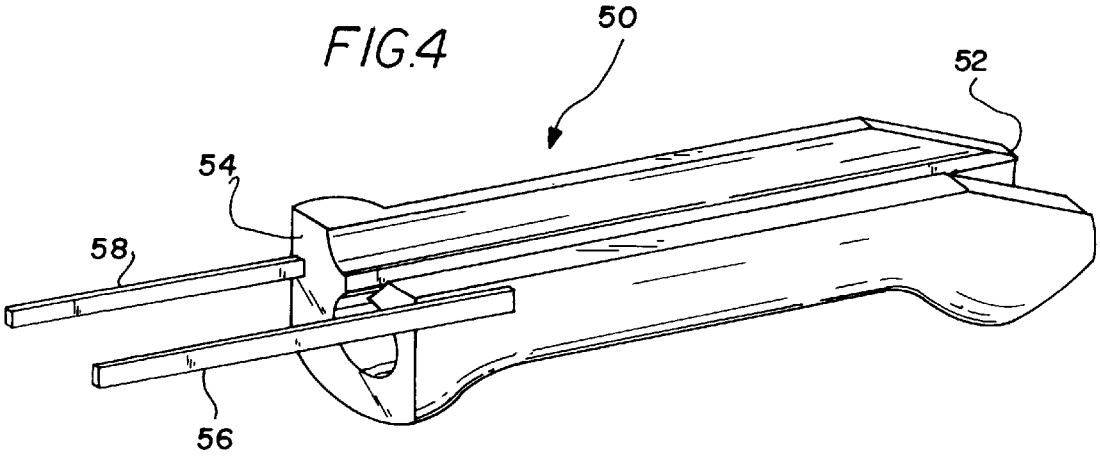
FIG. 4 is a perspective view of a forearm member of the present invention.

Preferably, as illustrated in FIG. 4, each forearm member 50 has a front end 52 and a rear end 54. An inner action slide finger 56 is spaced apart from an outer action slide finger 58 and both slide fingers 56, 58 extend from the forearm member rear end 54. Preferably, as seen in FIGS. 3 and 5, each inner action slide finger 56 is slidably disposed within a brace member slide finger channel 66. Referring to FIG. 1, the slide fingers 56, 58 are removably inserted into the receiver 20 and coupled to the bolts 29.

Ideally, as shown in FIG. 5, the forearm members 50 are designed to be pumped simultaneously by one hand of a user. The forearm members 50 are also designed to be pumped individually so that one shot may be fired from one barrel 30 and a shell reloaded into only that barrel 30. In the latter situation, a particular bolt 29 is opened to discharge the spent shell by sliding the forearm member 50 corresponding to that bolt toward the receiver 20, thereby pushing the slide fingers 56, 58 back which in turn push the bolt 29 into an open position. Then a new shell is chambered by sliding the forearm member 50 forward, thereby pulling the slide fingers 56, 58 to close the bolt 29.

The brace member 60 is coupled to the receiver front end 22. Preferably, as seen in FIG. 5, the brace member 60 is interposed between the barrels 30 as well as the magazine tubes 40. The brace member 60 has a pair of barrel mounts 68 upon which the barrels 30 are mounted. Ideally, the barrel mounts 68 extend between the brace member rear end 64 and the brace member front end 62 to assist in dissipating heat from the barrels 30.

Also preferably, as seen in FIGS. 3 and 5, the brace member 60 has a pair of slide finger channels 66 extending from the brace member front end 62 to the brace member rear end 64.

Preferably, a stock 70 is coupled to the receiver rear end 24. Optionally, a pistol grip (not shown) is coupled to the receiver 20 along with the stock 70. Also optionally, a pistol grip is coupled to the receiver 20 with no stock 70 attached to the receiver 20.

Also optionally, an ambidextrous trigger safety (not shown) may be included on the invention. Preferably, the trigger safety may be located near the grip of the stock 70 near the rear of the trigger guard.

In use, the double barrel shotgun magazine tubes 40 are loaded with shells. A shell is loaded into a chamber by pulling a forearm member 50 towards the receiver 20 and then pushing the forearm member 50 away from the receiver 20 until the bolt 29 is against the barrel rear end 34. The user may fire one shot by pulling only one trigger 27. The user may also fire two shots by pulling both triggers 27. If only one shell has been fired, a new shell may be loaded into the corresponding barrel chamber by pumping the forearm member 50 corresponding to the barrel 30 from which the shell was fired. If both shells have been fired, both forearm members 50 may be pulled simultaneously to reload both chambers.

If one of the barrels 30 becomes unusable, such as because of jamming, the other barrel 30 may be fired and reloaded by pumping only the corresponding forearm member 50.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A double barrel shotgun, comprising:

a receiver having a front end;

a pair of spaced apart elongate barrels each having a front end and a rear end, said rear ends of said barrels being coupled to said receiver front end;

a pair of spaced apart elongate magazine tubes each having a front end and a rear end, said rear ends of said magazine tubes being coupled to said receiver front end;

a pair of spaced apart forearm members, each forearm member being mounted to a said magazine tube, each said forearm member being for ejecting a spent shell from said receiver and loading a new shell into said receiver from a said magazine tube;

an elongate brace member having a front end, a rear end, said brace member rear end being coupled to said receiver front end, said brace member being interposed between said barrels, said brace member being interposed between said magazine tubes, each said barrel being coupled to said brace member, each said forearm member being slidable along said brace member, said brace member being for helping dissipate heat from said barrels.

2. The double barrel shotgun of claim 1, wherein said brace member has a pair of barrel mounts, each said barrel being coupled to a said barrel mount of said brace member.

3. The double barrel shotgun of claim 2, wherein each said barrel mount is extended between said brace member rear end and said brace member front end.

4. The double barrel shotgun of claim 3, wherein each forearm member has a front end, a rear end, an inner action slide finger, and an outer action slide finger, said forearm inner action slide finger being spaced apart from said forearm outer action slide finger, said forearm member inner action slide finger and said forearm member outer action slide finger being extended from said forearm rear end, said forearm member inner action slide finger and said forearm member outer action slide finger being removably insertable into said receiver.

5. The double barrel shotgun of claim 4, wherein said brace member has a pair of finger channels, each said finger channel being extended from said brace member rear end towards said brace member front end, and wherein each said inner action slide finger of said forearm members is slidably disposed within a said finger channel of said brace member.

6. The double barrel shotgun of claim 5, further comprising a stock being coupled to said receiver rear end.

7. The double barrel shotgun of claim 6, wherein each said magazine tube being positioned beneath a said barrel.

8. The double barrel shotgun of claim 7, wherein each said magazine tube is coupled to a said barrel.

9. The double barrel shotgun of claim 1, wherein each forearm member has a front end, a rear end, an inner action slide finger, and an outer action slide finger, said forearm inner action slide finger being spaced apart from said forearm outer action slide finger, said forearm member inner action slide finger and said forearm member outer action slide finger being extended from said forearm rear end, said forearm member inner action slide finger and said forearm member outer action slide finger being removably insertable into said receiver.

10. The double barrel shotgun of claim 9, wherein said brace member has a pair of finger channels, each said finger channels being extended from said brace member rear end towards said brace member front end, and wherein each said inner action slide finger of said forearm members is slidably disposed within a said finger channel of said brace member.

11. The double barrel shotgun of claim 1, further comprising a stock being coupled to said receiver rear end.

12. The double barrel shotgun of claim 1, wherein each said magazine tube being positioned beneath a said barrel.

13. The double barrel shotgun of claim 12, wherein each said magazine tube is coupled to a said barrel.

14. A double barrel shotgun, comprising:

a receiver having a front end and a rear end;

a stock being coupled to said receiver rear end;

an elongate first barrel having a front end and a rear end, said first barrel rear end being coupled to said receiver front end;

an elongate first magazine tube having a front end and a rear end, said first magazine tube rear end being coupled to said receiver front end at a position beneath said first barrel, said first magazine tube being coupled to said first barrel;

a first forearm member having a front end, a rear end, an inner action slide finger, and an outer action slide finger, said first forearm member being slidably mounted to said first magazine tube, said first forearm inner action slide finger being spaced apart from said first forearm outer action slide finger, said first forearm member inner action slide finger and said first forearm member outer action slide finger being extended from said first forearm rear end, said first forearm member inner action slide finger and said first forearm member outer action slide finger being removably insertable into said receiver, said first forearm member being for ejecting a spent shell from said receiver and loading a new shell into said receiver from said first magazine tube;

an elongate second barrel having a front end and a rear end, said second barrel rear end being coupled to said receiver front end, said second barrel being spaced apart from said first barrel;

an elongate second magazine tube having a front end and a rear end, said second magazine tube rear end being coupled to said receiver front end at a position beneath said second barrel, said second magazine tube being coupled to said second barrel, said second magazine tube being spaced apart from said first magazine tube;

a second forearm member having a front end, a rear end, an inner action slide finger, and an outer action slide finger, said second forearm member being slidably mounted to said second magazine tube, said second forearm inner action slide finger being spaced apart from said second forearm outer action slide finger, said second forearm member inner action slide finger and said second forearm member outer action slide finger being extended from said second forearm rear end, said second forearm member inner action slide finger and said second forearm member outer action slide finger being removably insertable into said receiver, said second forearm member being for ejecting a spent shell from said receiver and loading a new shell into said receiver from said second magazine tube; and an elongate brace member having front end, a rear end, a first barrel mount, a second barrel mount, a first finger channel, a second finger channel, said brace member being coupled to said receiver front end, said first barrel mount being extended between said brace member rear end and said brace member front end, said second barrel mount being extended between said brace member rear end and said brace member front end, said first finger channel being extended from said brace member rear end towards said brace member front end, said second finger channel being extended from said brace member rear end towards said brace member front end, said brace member being interposed between said first barrel and said second barrel, said brace member being interposed between said first magazine tube and said second magazine tube, said first barrel being coupled to said brace member first barrel mount, said first forearm member inner action slide finger being slidably disposed within said brace member first finger channel, said second barrel being coupled to said brace member second barrel mount, said second forearm member inner action slide finger being slidably disposed within said brace member second finger channel, said brace member being for helping dissipate heat from said first barrel and said second barrel.

* * * * *